United States Patent [19]

Yamasaki et al.

[11] Patent Number: 4,910,084

[45] Date of Patent: Mar. 20, 1990

[54] INK JET RECORDING MEDIUM

[75] Inventors: Takeshi Yamasaki, Funabashi; Hideaki Senoo, Tokyo; Masaru Andoh, Tokyo, all of Japan

[73] Assignee: Mitsubishi Paper Mills, Ltd., Tokyo, Japan

[21] Appl. No.: 188,501

[22] Filed: Apr. 29, 1988

[30] Foreign Application Priority Data

May 1, 1987 [JP] Japan ..... 62-109300
May 13, 1987 [JP] Japan ..... 62-118043

[51] Int. Cl.[4] ..... B41M 5/00

[52] U.S. Cl. ..... 428/411.1; 428/195; 428/513; 525/328.2; 525/35.3; 525/35.5; 525/359.5; 525/403; 526/312; 528/405

[58] Field of Search ..... 525/403, 328.2, 353, 525/355, 359.5; 528/405; 428/195, 411.1, 513; 526/312

[56] References Cited

U.S. PATENT DOCUMENTS 3,819,541 6/1974 Longoria, III et al. ..... 528/408
4,198,269 4/1980 Evani et al. ..... 525/403
4,613,525 9/1986 Miyamoto et al. ..... 428/195

*Primary Examiner*—Pamela R. Schwartz
*Attorney, Agent, or Firm*—Armstrong, Nikaido, Marmelstein, Kubovcik & Murray

[57] ABSTRACT

An ink jet recording medium containing a poly(dialkanol allylamine) derivative or a poly(dialkanol modified alkylene glycol) derivative in a support or in an ink receiving layer formed on the substrate or coated on the ink receiving layer provides images or letters of high density and of superior water resistance and light resistance.

17 Claims, No Drawings

INK JET RECORDING MEDIUM

BACKGROUND OF THE INVENTION

This invention relates to a recording meduim for recording with an ink and, more particularly, to an ink jet recording medium which provides images or letters of high density and of superior water resistance and light resistance.

Ink jet recording system performs recording of images or letters by squirting fine drops of ink by various actuation principles onto recording media such as paper. These ink jet recording systems have characteristics such as high-speed and low-noise recording, easy multicolor recording, great versatility of recording patterns and do not require development and fixation. Such systems rapidly becoming popular in various uses such in recording devices for various figures including Chinese characters and color images. Furthermore, multicolor ink jet recording systems can provide images which are by no means inferior to those obtained by multicolor printing with printing plates or by color photographic methods and thus, because of these systems are less expensive than photographic method, ink jet systems are increasingly being employed even in the fields of fullcolor image recording if many prints are not required.

In an attempt to use wood free papers or coated papers as used in ordinary printing or writing, as a medium for ink jet systems, efforts are focused on improving devices and composition of ink. However, with improvements in performances of ink jet recording devices such as recording speed and precision of recorded images and with enlargement of uses such as full coloration of images, new recording medium is also required to posses improved characteristics, for example, as follows: It should provide ink dots of high density and clear and bright color; It should rapidly absorb ink, causing neither flowing nor blotting of ink when ink dots overlap; Ink dots should not unnecessarily spread in a planar direction and the periphery of the dots should be smooth and unblurred. Furthermore, it is required that when recorded images are exposed to unltraviolet rays, oxygen or water, dye resistance should not decrease and preferably is enhanced.

Some proposals have been made to solve these problems. For example, Japanese Patent Application Kokai (Laid-Open) No. 52-53012 discloses an ink jet recording paper which comprises a raw paper of low size content which is wetted with a surface finishing coating composition. Japanese Pat. application Kokai (Laid-Open) No. 53-49113 discloses an ink jet recording paper which comprises a paper containing urea-formalin resin powders impregnated with a water-soluble polymer. These ink jet recording papers of plain paper type have rapid ink absorbing properties, but still suffer from the defects in that the periphery of ink dot tends to be blurred and the density of dot is low.

Further, Japanses Patent Application Kokai (Laid-Open) No. 55-5830 discloses an ink jet recording paper comprising a support provided with an ink absorbing coating layer on the surface; Japanese Patent Application Kokai (Laid-Open) No. 55-51583 discloses an example of using non-colloidal silica powder as pigment in the coating layer; Japanese Patent Application Kokai (Laid-Open) No. 55-11829 discloses a paper coated with two layers having different ink absorbing rates and especially Japanese Patent Application (Laid-Open) Nos. 59-174381, 60-44386, 60-132785 and 60-171143 disclose ink jet recording papers provided with transparent ink receiving layers. These ink jet recording media of coated type are superior substrates relative to ink jet recording papers of plain paper type in providing dots of better diameter and shape, image density and reproducibility of color tone, but these substrates are also defective in that aqueous ink containing water-soluble dye is often used for them and if an image formed on the media is splashed with water, the dye redissolved and diffuses, resulting in a considerable reduction of the value of the record. The dye is severely deteriorated due to high light transmittance and gas permeability of the ink receiving layer.

Improving the water resistance has been proposed as follows: The application water-soluble salts of metal to the recording surface (Japanese Patent Application Kokai (Laid-Open) No. 55-53591); a recording medium containing a polycationic high polymer electrolyte in the surface (Japanese Patent Application Kokai (Laid-Open) No. 56-84992); use of a water resistant agent which forms a lake with the dye in the ink after ink jet recording (Japanese Patent Application Kokai (Laid-Open) No. 55-150396); a method of rendering the images ink-jet recorded on a recording sheet, water resistant by coating with water-soluble polymer by insolubilizing said water-soluble polymer (Japanese Patent Application Kokai (Laid-Open) No. 56-58869); Insolubilization of the dye with a halogenated quaternary ammonium or salt of alkylammonium (Japanese Patent Application Kokai (Laid-Open) Nos. 56-99693 and 59-96987); Converting dye to lake with water-soluble salts of metals (Japanese Patent Application Kokai (Laid-Open) No. 59-96988).

However, these methods, are not totally effective in rendering images water resistant. Additional water resistant agents cause some reactions with the dye, resulting in considerable reduction in stability of dye, and as a result it is difficult to obtain well-balanced quality as recording medium.

On the other hand, in order to improve light resistance of recorded images, Japanese Patent Application Kokai (Laid-Open) Nos. 54-68303, 54-85804 and 56-18151 propose addition of ultraviolet absorbers to ink solution. However, these ultraviolet absorbers cause reduction of the jetting stability of ink and cannot be added in a large amount because of their low solubility. Small additions provide only a small effect. Another solution, relates to the addition of ultraviolet absorbers such as benzophenone and benzotriazole compounds to an ink jet recording sheet as disclosed in Japanese Patent Application Kokai (Laid-Open) Nos. 57-74192, 57-74193 and 57-87988. However, these ultraviolet absorbers have problems in that their solubility in water is low and cannot be used in a large amounts. The addition of small amounts cannot provide sufficient effect and if they are emulsified, the emulsion gives adverse results. Still another is disclosed in, Japanese Patent Application Kokai (Laid-Open) Nos. 61-43593 and 61-47290 which propose the addition of metal slats such as weak acid salts of alkali metals. However, when these are used in large amounts, the color quality of images is deteriorated and when used in a small amount, the effect is small.

Furthermore, due to the problem that use of a water resistant agent in combination with ultraviolet absorber damages effects, it has been very difficult to obtain recording media which can provide images balanced in quality and having high color quality, water resistance and light resistance and superior ink absorbability.

SUMMARY OF THE INVENTION

An object of this invention is to provide an ink jet recording medium for forming recording images by jetting thereon an aqueous ink which can provide recorded images having an improved water resistance and light resistance and is superior in recording properties, namely, high in recording speed and precision and superior in image storage stability.

This invention provides an ink jet recording medium for forming recorded images using an aqueous ink containing at least one water-soluble dye selected from the group consisting of direct dye, acid dye, basic dye, reactive dye and coloring material for food, said recording medium containing a poly(dialkanol allylamine) derivative represented by the formula:

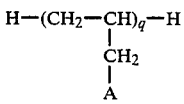

(I)

and/or a poly(dialkanol modified alkylene glycol) derivative represented by the formula:

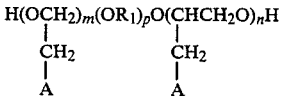

(II)

wherein $R_1$ represents an alkylene group of 2 to 4 carbon atoms or a hydroxyalkylene group of 3 to 4 carbon atoms; p represents an interger of 1 to 3; A represents a tertiary and/or quarternary dialkanolamino group represented by the following formula (III) and/or (IV); m and n each represents an interger of 5 to 50 and the sum of m and n is an interger of 10 to 100; an q represents an interger of 10 to 1000,

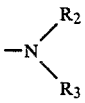

(III)

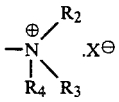

(IV)

wherein $R_2$ and $R_3$ each represents a hydroxylalkyl group of 2 to 3 carbon atoms; $R_4$ represents a hydrogen atom or an alkyl group of 1 to 2 carbon atoms; and $X^{\ominus}$ represents a halogen or an anion represented by $CH_3SO_4^{\ominus}$ or $C_2H_5SO_4^{\ominus}$.

DESCRIPTION OF THE PREFERRED EMBODIMENTS

The poly(dialkanol allylamine) derivative (referred to as "PAA" hereinafter) used in this invention can be prepared, for example, by the following process.

An alkylene oxide is allowed to react with a polyallylamine of a given molecular weight as an aqueous solution at 40°-60° C. to form an additional product, which is, if necessary, further reacted with a given amount of an alkyl halide or dialkylsulfuric acid at 60°-80° C. to obtain the objective tertiary ammonium, partial quaternary ammonium salt and overall quaternary ammonium salt.

The poly(dialkanolamino modified alkylene glycol) derivative containing glycol as a linking group (referred to as "PAA-AG derivative" hereinafter) is used in this invention and can be prepared, for example, by the following method.

(1) Polyepihalohydrin with glycol as a linking group which is obtained by the addition reaction of a glycol such as ethylene glycol with a given amount of epihalohydrin using $BF_3$ as a catalyst at 60°-80° C. is reacted with N-alkyldialkanolamine at 100°-150° C. under a nitrogen stream to obtain the objective quaternary ammonium salt.

(2) Polyepihalohydrin obtained in the same manner as above is reacted with a dialkanolamine at 80°-120° C. in a solvent in the presence of a dehydrochlorination agent to obtain a PAA-AG derivative. If necessary, this product is desalted and thereafter is reacted with a given amount of a dialkylsulfuric acid or alkyl halide at the above temperture to obtain the objective tertiary ammonium and partial quaternary ammonium salt.

The recording medium of this invention which contains the PAA derivative and/or PAA-AG derivative can be produced, for example, by the following methods: a method where a size press solution containing PAA derivative and/or PAA-AG derivative is impregnated in or coated on a support during manufacturing thereof on a papermaking machine from a slurry of macerated pulp fibers by a size press device provided in the papermaking machine; a method where a coating composition containing PAA derivative and/or PAA-AG derivative is coated on a support by ordinary coating devices such as roll coater, reverse roll coater, air knife coater, blade coater and spray coater and then dried to from an ink receiving layer containing PAA derivative and/or PAA-AG derivative; and a method wherein molten PAA and/or PAA-AG derivatives are coated on an ink receiving layer comprising ink absorbing pigments, adhesives and the like provided on a support. In this case, fillers, pigments, adhesives and other additives for general use may also be added.

In the case of impregnating the support in a solution containing a PAA derivative and/or a PAA-AG derivative, there can be used the PAA derivative and/or PAA-AG derivative preferably in an amount of 0.4 to 3 $g/m^2$. In this case, the solution may contain one or more pigments and/or a water-soluble binder.

In the case of coating a coating composition containing a PAA derivative and/or a PAA-AG derivative on the support, there can be used for the PAA derivative and/or PAA-AG derivative preferably in an amount of 0.4 to 10 $g/m^2$, more preferably 0.5 to 7 $g/m^2$. The coating layer may be a single layer or a plurality of layers. The amount of the coating composition changes depending on its purpose and required absorbability. The coating composition may contain one or more pigments, binders and other additives, The total amount of pigments, and the PAA derivative and/or PAA-AG derivative to be coated on the support is 0.4 to 50 $g/m^2$, preferably 5 to 40 $g/m^2$, on a dry basis. The amount of the coating composition is changed depending on the required absorbability, resolving power, water resistance, light resistance, etc.

More specifically, it is preferably to use 5 to 50 parts by weight, more preferably 10 to 30 parts by weight, of the PAA derivative and/or PAA-AG derivative per 100 parts by weight of the pigment.

In another embodiment, the PAA derivative and/or PAA-AG derivative may be contained in a pulp slurry.

The fillers and pigments used in this invention include, for example, white inorganic pigments such as light calcium carbonate, ground calcium carbonate, kaolin, talc, calcium surfate, barium sulfate, titanium oxide, zinc oxide, zinc sulfide, zinc carbonate, satin white, aluminum silicate, diatomaceous earth, calcium silicate, magnesium silicate, synthetic amorphous silica, aluminum hydroxide, alumina and lithopone and organic pigments such as styrene plastic pigments, acrylic plastic pigments, microcapsules and urea resin pigments. The preferred addition is synthetic amorphous silica.

Synthetic silica used in this invention means synthetic silicon compounds mainly composed of silicon dioxide, such as dry process silica obtained by thermal decomposition of silicon tetrachloride; so-called white carbon, such as metathesis precipitation products of sodium silicate with acids, carbon dioxide, ammonium salts, etc.; silica sol obtained by the thermal decomposition of soduim silicate with acids or obtained by passing sodium silicate through ion exchange resin; colloidal silica obtained by digestion of said silica sol with heating; silica gel which comprises three dimensional secondary particles formed through siloxane bond of primary particles of several millimicrons to several ten millimicrons obtained by gelation of silica sol with changing gelation conditions; and so-called synthetic molecular sieves produced by heating silica sol, sodium silicate, sodium aluminate, etc. as starting materials at 80°-120° C.

As the adhesives used in this invention, mention may be made of, for example, aqueous adhesives, e.g., cellulose derivatives such as oxidized starch, etherified starch, carboxymethylcellulose and hydroxyethylcellulose, casein, gelatin, soybean protein, polyvinyl alcohol and derivatives thereof, maleic anhydride resin, conjugated diene polymer latices such as usual styrene-butadiene copolymer and methyl methacrylate-butadiene copolymer, acryl polymer latices such as polymers or copolymers of acrylic esters and methacrylic esters, vinyl polymer latices such as ethylene-vinyl acetate copolymer, functional group-modified polymer latices obtained by modification of said various polymers with monomers containing functional group such as carboxyl group, thermosetting synthetic resins such as melamine resin and urea resin and synthetic resin adhesives such as polymethyl methacrylate, polyurethane resin, unsaturated polyester resin, vinyl chloride-vinyl acetate copolymer, polyvinyl bytyral and alkyd resin. These may be used alone or in combination of two or more. These adhesives may be used in an amount of 2-100 parts by weight, perferably 5-30 parts by weight per 100 parts by weight of pigment, but this ratio is not critical as far as it is enough to bind the pigment. However, use of more than 100 parts by weight of adhesive is not preferred because intersticial structure is reduced or interstices become too small due to film formation of the adhesive.

Other additives which maybe included in the composition are pigment dispersants, thickeners, fluidity modifiers, antifoamers, foam-inhibitors, releasing agents, foaming agents, penetrants, colored dyes, colored pigments, fluorescent brighteners, ultraviolet ray absorbers, anti-oxidants, preservatives, antifungal agents, and waterproofing agents. These may be used in optional amounts.

As supports, there may be used sheet-like materials such as paper and thermoplastic resin films. Papers may be free from sizing agents or may be properly sized and may or may not contain fillers.

The thermoplastic resin films used include, for example, transparent films such as polyester, polystyrene, polyvinyl chloride, polymethyl methacrylate, cellulose acetate, polyethylene and polycarbonate and white opaque films filled with white pigments or containing fine foams. The white pigments include, for example, titanium oxide, calcium sulfate, calcium carbonate, silica, clay, talc, zinc oxide and the like.

Additionally laminate papers comprising a paper laminated with resin films or finished with molten resins may also be used as supports. Such laminated papers may be subjected to a rubbing treatment or corona discharge treatment in order to improve adhesion between the surface of the resin and ink receiving layer.

A sheet obtained by coating the ink receiving layer on the support may be used as is i.e. as a recording sheet of this invention, but the surface may be made smooth by passing it through a roll nip under heating and/or pressure by supercalender or gloss calender processes. In this case, excess treatment by supercalender causes reduction of ink absorption through interstices between particles and so the degree of treatment must be controlled.

The aqueous ink used in this invention is a recording liquid comprising the following colorant, liquid medium and other additives.

The colorants include water-soluble dyes such as direct dyes, acid dyes, basic dyes, reactive dyes and coloring matters for food.

The direct dyes include, for example, the following:

C.I. Direct Black 2, 4, 9, 11, 14, 17, 19, 22, 27, 32, 36, 38, 41, 48, 49, 51, 56, 62, 71, 74, 75 77, 78, 80, 105, 106, 107, 108, 112, 113, 117, 132, 146, 154, 194

C.I. Direct Yellow 1, 2, 4, 8, 11, 12, 24, 26, 27, 28, 33, 34, 39, 41, 42, 44, 48, 50, 51, 58, 72, 85, 86, 87, 88, 98, 100, 110

C.I. Direct Orange 6, 8, 10, 26, 29, 39, 41, 49, 51, 102,

C.I. Direct Red 1, 2, 4, 8, 9, 11, 13, 17, 20, 23, 24, 28, 31, 33, 37, 39, 44, 46, 47, 48, 51, 59, 62, 63, 73, 75, 77, 80, 81, 83, 84, 85, 90, 94, 99, 101, 108, 110, 145, 189, 197, 220, 224, 225, 226, 227, 230

C.I. Direct Violet 1, 7, 9, 12, 35, 48, 51, 90, 94

C.I. Direct Blue 1, 2, 6, 8, 15, 22, 25, 34, 69, 70, 71, 72, 75, 76, 78, 80, 81, 82, 83, 86, 90, 98, 106, 108, 110, 120, 123, 158, 163, 165, 192, 193, 194, 195, 196, 199, 200, 201, 202, 203, 207, 218, 236, 237, 239, 246, 258

C.I. Direct Green 1, 6, 8, 28, 33, 37, 63, 64

C.I. Direct Brown 1A, 2, 6, 25, 27, 44, 58, 95, 100, 101, 106, 112, 173, 194, 195, 209, 210, 211

Acid dyes include, for example, the following:

C.I. Acid Black 1, 2, 7, 16, 17, 24, 26, 28, 31, 41, 48, 52, 58, 60, 63, 94, 107, 109, 112, 118, 119, 121, 122, 131, 155, 156

C.I. Acid Yellow 1, 3, 4, 7, 11, 12, 13, 14, 17, 18, 19, 23, 25, 29, 34, 36, 38, 40, 41, 42, 44, 49, 53, 55, 59, 61, 71, 72, 76, 78, 99, 111, 114, 116, 122, 135, 161, 172

C.I. Acid Orange 7, 8, 10, 33, 56, 64

C.I. Acid Red 1, 4, 6, 8, 13, 14, 15, 18, 19, 21, 26, 27, 30, 32, 34, 35, 37, 40, 42, 51, 52, 54, 57, 80, 82, 83, 85, 87, 88, 89, 92, 94, 97, 106, 108, 110, 115, 119, 129, 131, 133, 134, 135, 154, 155, 172, 176, 180, 184, 186, 187, 249, 254, 256, 317, 318

C.I. Acid Violet 7, 11, 15, 34, 35, 41, 43, 49, 75
C.I. Acid Blue 1, 7, 9, 22, 23, 25, 27, 29, 40, 41, 43, 45, 49, 51, 53, 55, 56, 59, 62, 78, 80, 81, 83, 90, 92, 93, 102, 104, 111, 113, 117, 120, 124, 126, 145, 167, 171, 175, 183, 220, 234, 236
C.I. Acid Green 3, 12, 19, 27, 41, 9, 16, 20, 25
C.I. Acid Brown 4, 14

Basic dyes include, for example, the following:
C.I. Basic Black 2, 8
C.I. Basic Yellow 1, 2, 11, 12, 14, 21, 32, 36
C.I. Basic Orange 2, 15, 21, 22
C.I. Basic Red 1, 2, 9, 12, 13, 37
C.I. Basic Violet 1, 3, 7, 10, 14
C.I. Basic Blue 1, 3, 5, 7, 9, 24, 25, 26, 28, 29
C.I. Basic Green 1, 4
C.I. Basic Brown 1, 12

Reactive dyes include, for example, the following:
C.I. Reactive Black 1, 3, 5, 6, 8, 12, 14
C.I. Reactive Yellow 1, 2, 3, 13, 14, 15, 17
C.I. Reactive Orange 2, 5, 7, 16, 20, 24
C.I. Reactive Red 6, 7, 11, 12, 15, 17, 21, 23, 24, 35, 36, 42, 63, 66
C.I. Reactive Violet 2, 4, 5, 8, 9
C.I. Reactive Blue 2, 5, 7, 12, 13, 14, 15, 17, 18, 19, 20, 21, 25, 27, 28, 37, 38, 40, 41
C.I. Reactive Green 5, 7
C.I. Reactive Brown 1, 7, 16

Coloring materials for food include, for example, the following:
C.I. Food Black 2
C.I. Food Yellow 3, 4, 5
C.I. Food Red 2, 3, 7, 9, 14, 52, 87, 92, 94, 102, 104, 105, 106
C.I. Food Violet 2
C.I. Food Blue 1, 2
C.I. Food Green 2, 3.

As the liquid media for aqueous ink, mention may be made of water and various water-soluble organic solvents, for example, alkyl alcohols of 1–4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethylformamide and dimethylacetamide; keytones or ketone alcohols such as acetone and diacetone alcohol; ethers such as tetrahydrofuran and dioxane; polyalkylene glycols such as polyethylene glycol and polypropylene glycol; alkylene glycols having 2–6 alkylene groups such as ethylene glycol, propylene glycol, butylene glycol, triethylene glycol, 1,2,6-hexanetriol, thiodiglycol, hexylene glycol and diethylene glycol; and lower alkyl ethers of polyhydric alcohols such as glycerin, ethylene glycol methyl ether, diethylene glycol methyl (or ethyl) ether and triethylene glycol monomethyl ether.

Of these water-soluble organic solvents, preferred are polyhydric alcohols such as diethylene glycol and lower alkyl ethers of polyhydric alcohols such as triethylene glycol monomethyl ether and triethylene glycol monoethyl ether.

Other additives include, for example, pH adjusters, sequestering agents, antifungal agents, viscosity modifiers, surface tension adjusters, wetting agents, surface active agents, and rust preventors.

Aptitude for ink jet recording were determined by the following methods.

Color density: Density of solid images obtained by printing with cyan ink (C), magenta ink (M), yellow ink (Y) and black ink (Bk) by ink jet color image printer (IO-720 manufactured by Sharp Corporation) was measured by Macbeth densitometer RD 514.

Light resistance: Solid image obtained by printing with Bk ink by ink jet printer (A-1210 manufactured by Canon, Inc.) was exposed to xenon fadeometer (FAL-25X-HCL manufactured by Suga Tester Co.) under illuminance of 41 $W/m^2$ at 40° C., 60% for 40 hours or exposed to sunlight for 24 hours. Sensory chromaticity ($L^*a^*b^*$) of the image before and after exposure to xenon light or sunlight was measured by a differential colorimeter (CR-100 manufactured by Minolta Camera Co., Ltd.) and color difference $\Delta E$ was obtained from sensory chromaticity difference ($\Delta L^*\Delta a^*\Delta b^*$) before and after exposure. The resulting value of color difference was employed as degree of discoloration and fading.

Ozone resistance: Solid image obtained by printing with Bk ink by ink jet printer (A-1210 manufactured by Canon, Inc.) was exposed to a stream of 3 $g/m^3$ ozone from an ozone generator (OS-1 manufactured by Mitsubishi Electric Corporation) for 5 minutes and color difference $\Delta E$ before and after exposure was obtained in the same manner as in measurment of light resistance. This value was employed as degree of discoloration and fading. For both the light resistance and ozone resistance, the smaller value indicates less discoloration and fading, namely, superior results.

Water resistance: Solid images obtained by printing with C, M, Y and Bk inks by the same ink jet printer of Canon, Inc. as used above were dipped in running water at 30° C. for 3 minutes and the density of the images before and after dipping was measured by Macbeth densitometer RD 514. Density after dipping was divided by density before dipping and the quotient was shown by percentage. This was employed as a value for water resistance. The higher the value, the better the water resistance.

Ink absorbing rate: Immediately after formation of a solid red image (magenta+yellow) by the ink jet printer of Sharp Corporation or Canon, Inc. (after about one second), the paper carrying the image was fed and allowed to contact with paper press roll or fingers. The ink absorbing rate was evaluated by the presence or absence of a stain.

The poly(dialkanol allylamine) derivative used in this invention acts as a water resistant agent for water-soluble dyes owing to its cationic property. Further this derivative also favorably acts on light resistance and storage stability of recorded images (especially, on light resistance and ozone resistance of black images).

Quaternary ammonium salts have been widely proposed as water a resistant agent for water-soluble dyes in ink jet recording media. Dialkanolamino modified products have also been proposed, but they provide images superior in water resistance, but are inferior in light resistance or superior in light resistance, and inferior water resistance.

The poly(dialkanol allylamine) derivative has a moderate molecular weight and hence the cationic property thereof can be freely changed depending on the combination of tertiary and quaternary compounds and thus agglomeration of pigments such as silica can be properly designed. This compound also exhibits a remarkable effect on fixation of water-soluble dyes. With reference to light resistance, the derivative inhibits fading of color due to composite effects of absorbability to silica and dyes and reducibility of aminoacohol terminal groups.

Therefore, this invention has been attained based on these complicated composite actions and not on any application of known techniques. In other words, this invention is based on an utterly new conception.

The following nonlimiting examples illustrate this invention. Parts and % in the examples are by weight. PAA derivatives used in the examples and comparative examples are shown in Table 1 and PAA-AG derivatives are shown in Tables 3 and 4.

EXAMPLE 1

To a pulp slurry comprising 80 parts of LBKP (hardwood bleached kraft pulp) having a freeness of 370 ml (CSF: Canadian Standard Freeness) and 20 parts of NBKP (soft bleached kraft pulp) having a freeness of 400 ml were added 20 parts of talc and 0.5 part of cationic starch (CatoF produced by Oji National Co.). A paper of 65 g/m$^2$ in basis weight was produced from the mixture by a wire paper machine. During production of the paper, a size press solution comprising 2% of polyvinyl alcohol (PVA 117 manufactured by Kuraray Co.), white carbon (NIPSIL LP manufactured by Japan Silica Co.) and 4% of Compound 3 shown in Table 1 (PAA derivative) was applied to the paper by a size press device. Thus treated paper was dried and finished by passing it through machine calender to obtain a recording paper. This recording paper was evaluated on ink jet aptitudes and the results are shown in Table 2.

COMPARATIVE EXAMPLE 1

A recording paper was produced in the same manner as in Example 1 except that the PAA derivative was omitted from the size press solution. Results of evaluation of ink jet aptitudes are shown in Table 2.

EXAMPLES 2–5

A base paper of 68 g/m$^2$ in basis weight was prepared by a wire paper machine from a slurry comprising 80 parts of LBKP having a freeness of 370 ml (CSF), 20 parts of NBKP having a freeness of 400 ml (CSF), 13 parts of ground calcium carbonate, 1 part of cationic starch, 0.08 part of alkyl ketene dimer sizing agent (HARCON W manufactured by Dick Hercules Co.) and 0.4 part of polyalkylenepolyamineepichlorohydrin resin. During preparation of the paper, 2 g/m$^2$ (solid content) of oxidized starch was applied thereto by a size press device to make a coated base paper. The Stöckigt sizing degree of this base paper was 21 seconds.

As a coating composition was prepared a solution of 18% in solid content composed of 100 parts of synthetic silica (MIZUKASIL P78D manufactured by Mizusawa Kagaku Kogyo Co.), 30 parts of polyvinyl alcohol (PVA 117 manufactured by Kuraray Co.) and 20 parts of one compounds 4–7 (PAA derivatives) shown in Table 1. This coating composition was coated on the surface of the base paper at a coverage of 10 g/m$^2$ (dry solid content) by a wire rod and was dried. Then, the coated paper was moderately supercalendered to obtain recording paper. Results of evaluation of these recording paper on ink jet aptitudes are shown in Table 2.

COMPARATIVE EXAMPLE 2

A recording paper was prepared in the same manner as in Examples 2–5 except that the PAA derivative was omitted from the coating composition. Results of evaluation of the recording paper on ink jet aptitudes are shown in Table 2.

COMPARATIVE EXAMPLE 3

A recording paper was prepared in the same manner as in Examples 2–5 except that compound 8 shown in Table 1 was used in place of the PAA derivative in the coating composition. This recording paper was evaluated on ink jet aptitudes to obtain the results as shown in Table 2.

EXAMPLES 6 and 7

As a coating composition was prepared a solution of 20% in solid content composed of 100 parts of synthetic silica (SYLOID 74 manufactured by FUJI Davidson Co.) and 30 parts of polyvinyl alcohol (PVA 117). The resulting coating composition was coated on the same coated base paper as prepared in Examples 2–5 at a coverage of 8 g/m$^2$ (dry solid content) by an air knife coater and dried to obtain a base paper having an ink receiving layer.

Separately, as a coating composition was prepared a solution of 10% in solid content composed of 100 parts of synthetic silica (FINESIL X37(B) manufactured by Tokuyama Soda Co.), 50 parts of polyvinyl alcohol (PVA 117) and 20 parts of one of compounds 1 and 2 (PAA derivatives) shown in Table 1. This coating composition was coated on the above obtained base paper at a coverage of 5 g/m$^2$ (dry solid content) and was dried. Thus coated papers were moderately supercalendered to obtain recording papers. These recording papers were evaluated on ink jet aptitudes and the results are shown in Table 2.

COMPARATIVE EXAMPLE 4

A recording paper was prepared in the same manner as in Examples 6 and 7 except that polyalkylenepolyaminedicyanodiamide ammonium salt condensate (NEOFIX RP-70 manufactured by Nikka Kagaku Co.) was used in place of the PAA derivative. This recording paper was evaluated on ink jet aptitudes and the results are shown in Table 2.

COMPARATIVE EXAMPLE 5

A recording paper was prepared in the same manner as in Examples 6 and 7 except that the PAA derivative was omitted. Ink jet aptitudes of this recording paper are shown in Table 2.

TABLE 1

| PAA derivatives | | | |
|---|---|---|---|
| | Content of structural formula [I] | | |
| | A | | |
| Compound | [III]/[IV] | (ratio) | q |
| 1 | 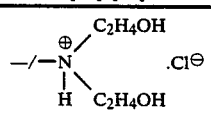 | (0/100) | 1000 |

TABLE 1-continued

| Compound | PAA derivatives<br>Content of structural formula [I]<br>A<br>[III]/[IV] | (ratio) | q |
|---|---|---|---|
| 2 | 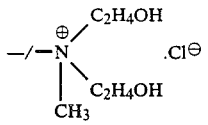 | (0/100) | 500 |
| 3 | 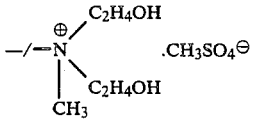 | (0/100) | 100 |
| 4 | 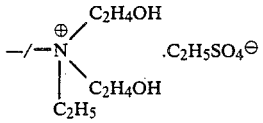 | (0/100) | 100 |
| 5 | 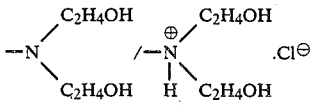 | (50/50) | 100 |
| 6 | 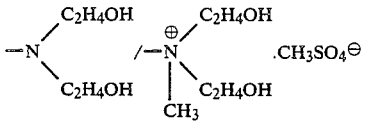 | (50/50) | 100 |
| 7 | 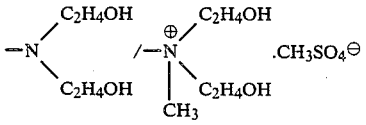 | (80/20) | 50 |
| 8 | 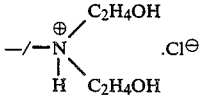 | (0/100) | 5 |

TABLE 2

| | PAA derivative | Water resistance (%) BK | Y | C | M | Degree of discoloration and fading (ΔE) Xenon fadeometer | Sunlight | Ozone | Ink absorbing rate *1 |
|---|---|---|---|---|---|---|---|---|---|
| Example 1 | No. 3 | 105 | 107 | 101 | 108 | 2.7 | — | 6.8 | o |
| Comparative Example 1 | — | 53 | 122 | 106 | 32 | 15.6 | — | 18.4 | o |
| Example 2 | No. 4 | 113 | 109 | 103 | 134 | 4.2 | — | 8.3 | o |
| Example 3 | No. 5 | 98 | 114 | 100 | 115 | 4.5 | — | 8.2 | o |
| Example 4 | No. 6 | 102 | 106 | 102 | 121 | 4.4 | — | 8.8 | o |
| Example 5 | No. 7 | 95 | 120 | 98 | 95 | 4.8 | — | 8.5 | o |
| Comparative Example 2 | — | 12 | 91 | 109 | 10 | 16.6 | — | 17.9 | o |
| Comparative Example 3 | No. 8 | 47 | 132 | 105 | 33 | 9.5 | — | 9.3 | o |
| Example 6 | No. 1 | 98 | 100 | 102 | 110 | — | 3.7 | 9.7 | o |
| Example 7 | No. 2 | 99 | 101 | 100 | 107 | — | 4.2 | 10.5 | o |
| Comparative Example 4 | NEOFIX RP-70 | 110 | 100 | 100 | 108 | — | 20.3 | 23.7 | o |
| Comparative Example 5 | — | 15 | 89 | 109 | 11 | — | 18.2 | 19.1 | o |

*1: The symbol "o" indicates good ink absorbing rate with practically no problem.

EXAMPLE 8

A recording paper was prepared in the same manner as in Example 1 except that compound 14 shown in Table 4 as PAA-AG derivative was used in place of PAA derivative. Ink jet aptitudes of this recording paper are shown in Table 5.

COMPARATIVE EXAMPLE 6

A recording paper was prepared in the same manner as in Example 8 except that PAA-AG derivative was omitted from the size press solution used in Example 8. Ink jet aptitudes of this recording paper are shown in Table 5.

EXAMPLES 9–12

Recording papers were prepared in the same manner as in Examples 2–5 except that compounds 9–12 shown in Table 3 as PAA-AG derivatives were used in place of PAA derivatives. Ink jet aptitudes of these recording papers are shown in Table 6.

COMPARATIVE EXAMPLE 7

A recording paper was prepared in the same manner as in Examples 9–12 except that PAA-AG derivative were omitted from the coating composition used in Examples 9–12. Ink jet aptitudes of this recording paper are shown in Table 6.

COMPARATIVE EXAMPLE 8

A recording paper was prepared in the same manner as in Examples 9–12 except that compound 13 shown in Table 3 was used in place of the PAA-AG derivatives in the coating composition used in Examples 9–12. Ink jet aptitudes of this recording paper are shown in Table 6.

EXAMPLES 13–18

Recording papers were prepared in the same manner as in Examples 6 and 7 except that compounds 14–19 shown in Table 4 as PAA-AG derivatives were used in place of the PAA derivatives. Ink jet aptitudes of these recording papers are shown in Table 7.

COMPARATIVE EXAMPLE 9

A recording paper was prepared in the same manner as in Examples 13–18 except that polyalkylene-polyaminedicyanodiamide ammonium salt condensate (NEOFIX RP-70 manufactured by Nikka Kagaku Co.) was used in place of the PAA-AG derivatives used in Examples 13–18. Ink jet aptitudes of this recording paper are shown in Table 7.

COMPARATIVE EXAMPLE 10

A recording paper was prepared in the same manner as in Examples 13–18 except that the PAA-AG derivative was omitted. Ink jet aptitudes of this recording paper are shown in Table 7.

EXAMPLE 19

A coating composition was prepared from a solution of solid content 10% of which is composed of polyvinyl alcohols (PVA 117: 50 parts and PVA 205: 50 parts) and 10 parts of compound 17 in Table 4 as PAA-AG derivative. This coating composition was coated on the surface of a transparent polyester film of 100 μm thick at a coverage of 15 g/m² (dry solid content) by a roll coater to obtain a transparent recording medium. Ink jet aptitudes of this recording medium are shown in Table 7.

COMPARATIVE EXAMPLE 11

A transparent recording medium was prepared in the same manner as in Example 19 except that the PAA-AG derivative was omitted. Ink jet aptitudes of this recording medium are shown in Table 7.

TABLE 3

| | PAA—AG derivatives | | | |
|---|---|---|---|---|
| | Content of structural formula [II] | | | |
| Compound | $R_1$ | p | A | m + n |
| 9 | $-CH_2CH_2-$ | −1 | 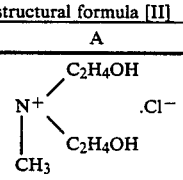 | 10 |
| 10 | " | " | " | 50 |
| 11 | " | " | " | 90 |
| 12 | " | 2 | " | 50 |
| 13 | " | 1 | " | 5 |

TABLE 4

| | PAA—AG derivatives | | | | |
|---|---|---|---|---|---|
| | Content of structural formula [II] | | | | |
| Compound | $R_1$ | p | A [III]/[IV] | (ratio) | m + n |
| 14 | $-CH_2CH_2-$ | 1 | 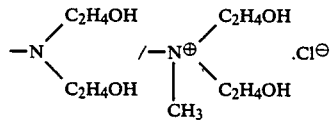 | (0.5/0.5) | 90 |
| 15 | " | " | " | (0.3/0.7) | 90 |
| 16 | " | " | " | (0.1/0.9) | 90 |
| 17 | " | " | 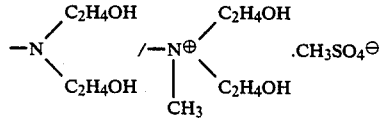 | (0.5/0.5) | 90 |
| 18 | " | " | " | (0.8/0.2) | 30 |
| 19 | $-CH_2CH(CH_3)-$ | " | " | (0.1/0.9) | 90 |

TABLE 5

| | PAA-AG derivative used | Discoloration and fading ΔE (Xenon fadeometer) | | | | Water resistance (%) | | | | Image density (O.D.) | | | | Ink absorbing rate |
|---|---|---|---|---|---|---|---|---|---|---|---|---|---|---|
| | | Bk | Y | C | M | Bk | Y | C | M | Bk | Y | C | M | |
| Example 8 | No. 14 | 4.9 | 7.8 | 6.0 | 33.3 | 102 | 107 | 103 | 105 | 0.91 | 0.60 | 0.87 | 0.96 | o |
| Comparative Example 6 | — | 15.6 | 7.7 | 10.8 | 45.4 | 53 | 122 | 106 | 32 | 0.87 | 0.59 | 0.86 | 0.93 | o |

TABLE 6

| | PAA-AG derivative used | Discoloration and fading ΔE (Xenon fadeometer) | | | | Water resistance (%) | | | | Image density (O.D.) | | | | Ink absorbing rate |
|---|---|---|---|---|---|---|---|---|---|---|---|---|---|---|
| | | Bk | Y | C | M | Bk | Y | C | M | Bk | Y | C | M | |
| Example 9 | No. 9 | 7.7 | 7.5 | 6.2 | 35.0 | 85 | 110 | 105 | 91 | 1.11 | 0.63 | 1.02 | 1.15 | o |
| Example 10 | No. 10 | 5.8 | 7.6 | 6.0 | 34.5 | 87 | 100 | 99 | 96 | 1.13 | 0.62 | 1.03 | 1.15 | o |
| Example 11 | No. 11 | 4.5 | 7.4 | 7.0 | 33.2 | 120 | 115 | 102 | 138 | 1.12 | 0.63 | 1.03 | 1.16 | o |
| Example 12 | No. 12 | 6.2 | 7.6 | 7.3 | 34.8 | 113 | 109 | 105 | 119 | 1.11 | 0.64 | 1.04 | 1.14 | o |
| Comparative Example 7 | — | 16.6 | 7.9 | 10.4 | 48.0 | 12 | 91 | 109 | 10 | 1.09 | 0.60 | 1.02 | 1.09 | o |
| Comparative Example 8 | No. 13 | 9.5 | 7.0 | 7.2 | 50.2 | 28 | 110 | 117 | 53 | 1.08 | 0.61 | 1.02 | 1.10 | o |

TABLE 7

| | PAA-AG derivative used | Image density (O.D.) | | | | Discoloration and fading ΔE (Sunlight 24 hr) | | | | Water resistance (%) | | | | Ink absorbing rate |
|---|---|---|---|---|---|---|---|---|---|---|---|---|---|---|
| | | Bk | Y | C | M | Bk | Y | C | M | Bk | Y | C | M | |
| Example 13 | No. 14 | 1.14 | 0.64 | 1.06 | 1.14 | 7.3 | 0.8 | 1.4 | 3.9 | 130 | 100 | 103 | 123 | |
| Example 14 | No. 15 | 1.12 | 0.64 | 1.05 | 1.13 | 5.4 | 0.6 | 0.7 | 2.0 | 142 | 101 | 105 | 116 | o |
| Example 15 | No. 16 | 1.13 | 0.65 | 1.06 | 1.14 | 5.2 | 0.6 | 0.8 | 2.3 | 138 | 100 | 106 | 118 | o |
| Example 16 | No. 17 | 1.16 | 0.65 | 1.09 | 1.15 | 6.8 | 0.7 | 1.2 | 3.5 | 106 | 100 | 100 | 102 | o |
| Example 17 | No. 18 | 1.15 | 0.64 | 1.08 | 1.15 | 7.7 | 1.0 | 1.6 | 3.8 | 107 | 100 | 102 | 110 | o |
| Example 18 | No. 19 | 1.14 | 0.65 | 1.06 | 1.14 | 7.1 | 1.1 | 1.2 | 3.3 | 113 | 102 | 103 | 115 | o |
| Comparative Example 9 | NEOFIX RP-70 (Nikka kagaku Co.) | 1.12 | 0.64 | 1.06 | 1.13 | 20.3 | 1.0 | 1.9 | 15.1 | 110 | 100 | 100 | 108 | o |
| Comparative Example 10 | — | 1.08 | 0.60 | 0.99 | 1.06 | 18.2 | 1.1 | 2.2 | 5.6 | 15 | 89 | 109 | 11 | o |
| Example 19*1 | No. 17 | o | | | | o | | | | o | | | | o |
| Comparative Example 11*1 | — | o | | | | x | | | | x | | | | o |

*1Image density, degree of discoloration and fading and water resistance in Example 19 and Comparative Example 11 were visually determined. The symbol "o" for image density indicates high density. The symbols "o" and "x" for discoloration and fading ΔE indicate less discoloration and fading and much discoloration and fading, respectively. The symbol "o" for water resistance indicates good water resistance and the symbol "x" indicates low water resistance ofmagenta and black images. The symbol "o" for ink absorbingrate in Tables 5, 6 and 7 indicates good absorbing rate with practically no problem.

As explained above, according to the ink jet recording medium of this invention which contains poly(dialkanolallylamine) derivative or poly(dialkanolamino modified alkylene glycol) derivative containing a glycol as a linking group, not only water resistance can be imparted to recorded images, but also color quality of the images can be improved and besides, light resistance and ozone resistance of black images are markedly improved.

What is claimed is:

1. In an ink jet recording medium including a substrate for recording images with an aqueous ink wherein the improvement comprises impregnating or coating the substrate of said recording medium with at least one member selected from the group consisting of a poly(dialkanol allylamine) derivative of the formula:

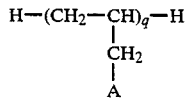

(I)

and a poly(dialkanol modified alkylene glycol) derivative of the formula:

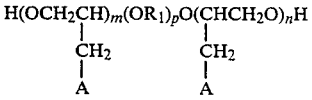

(II)

wherein $R_1$ is an alkylene group having 2 to 4 carbon atoms or a hydroxyalkylene group having 3 to 4 carbon atoms; p is an integer of 1 to 3; A is a tertiary and/or quaternary dialkanolamino group represented by the formulae:

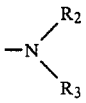

(III)

and

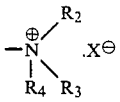

(IV)

in which $R_2$ and $R_3$ are independently a hydroxyalkyl group having 2 to 3 carbon atoms; $R_4$ is hydrogen or an alkyl group having 1 to 2 carbon atoms; and $X^{\ominus}$ is halogen or an anion of the formula: $CH_3SO_4^{\ominus}$ or $C_2H_5SO_4^{\ominus}$; m and n are independently an integer of 5 to 50 and $m+n=10$ to 100; and q is an integer of 10 to 1000.

2. An ink jet recording medium according to claim 1, wherein said at least one member for impregnating or coating the substrate of the recording medium contains a poly(dialkanol allylamine) derivative of the formula:

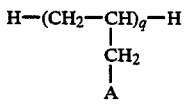

(I)

wherein A is a tertiary and/or quanternary dialkanolamino group represented by the formulae:

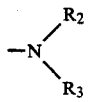

(III)

and

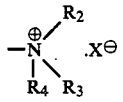

(IV)

in which $R_2$ and $R_3$ are independently a hydroxyalkyl group having 2 to 3 carbon atoms; $R_4$ is hydrogen or an alkyl group having 1 to 2 carbon atoms; and $X^{\ominus}$ is halogen or an amino of the formula: $CH_3SO_4^{\ominus}$ or $C_2H_4SO_4^{\ominus}$; and q is an integer of 10 to 1000.

3. An ink jet recording medium according to claim 1, wherein said at least one member for impregnating or coating the substrate of the recording medium contains a poly(dialkanol modified alkylene glycol) derivative of the formula:

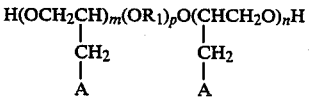

(II)

wherein $R_1$ is an alkylene group having 2 to 4 carbon atoms or a hydroxyalkylene group having 3 to 4 carbon atoms; p is an integer of 1 to 3; A is a tertiary and/or quaternary dialkanolamino group represented by the formulae:

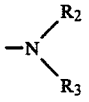

(III)

and

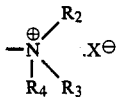

(IV)

in which $R_2$ and $R_3$ are independently a hydroxyalkyl group having 2 to 3 carbon atoms; $R_4$ is hydrogen or an alkyl group having 1 to 2 carbon atoms; and $X^{\ominus}$ is halogen or an anion of the formula: $CH_3SO_4^{\ominus}$ or $C_2H_5SO_4^{\ominus}$; and m and n are independently an integer of 5 to 50 and $m+n=10$ to 100.

4. An ink jet recording medium according to claim 3, wherein the poly(dialkanol modified alkylene glycol) derivative of the formula (II) is:

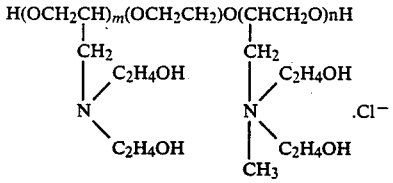

(II)

wherein $m+n=90$.

5. An ink jet recording medium according to claim 3, wherein the poly(dialkanol modified alkylene glycol) derivative of the formula (II) is

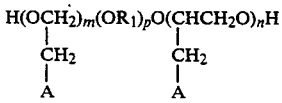

(II)

wherein $R_1$ is an alkylene group having 2 to 3 carbon atoms; p is an integer of 1 or 2; A is a tertiary and/or quaternary dialkanolamino group represented by the formulae:

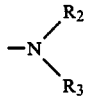

(III)

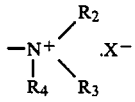

(IV)

in which $R_2$ and $R_3$ are independently a hydroxyalkyl group having 2 carbon atoms; $R_4$ is an alkyl group having 1 carbon atom; X is Cl or an anion of the formula: $CH_3SO_4$; m and n are independently an integer of 5 to 50 and $m+n=10$ to 90.

6. The ink jet recording medium of claim 1 wherein the aqueous ink contains at least one water-soluble dye selected from the group consisting of direct dyes, acidic dyes, basic dyes and reactive dyes.

7. The ink jet recording medium of claim 1 wherein the aqueous ink contains a water-soluble dye which is a coloring material for food.

8. An ink jet recording medium for receiving an aqueous ink, said recording medium obtained by impregnating a support with a solution containing a poly(dialkanol allylamine) derivative of the formula:

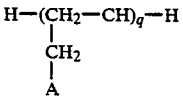

(I)

and/or a poly(dialkanol modified alkylene glycol) derivative of the formula:

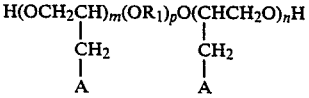

(II)

wherein $R_1$ is an alkylene group having 2 to 4 carbon atoms or a hydroxyalkylene group having 3 to 4 carbon atoms; p is an integer of 1 to 3; A is a tertiary and/or quaternary dialkanolamino group represented by the formulae:

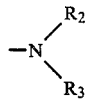

(III)

and

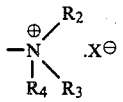

(IV)

in which $R_2$ and $R_3$ are independently a hydroxyalkyl group having 2 to 3 carbon atoms; $R_4$ is hydrogen or an alkyl group having 1 to 2 carbon atoms; and $X^{\ominus}$ is halogen or an anion of the formula: $CH_3SO_4^{\ominus}$ or $C_2H_5SO_4^{\ominus}$; m and n are independently an integer of 5 to 50 and $m+n=10$ to 100; and q is an integer of 10 to 1000.

9. The ink jet recording medium of claim 8 wherein the aqueous ink contains at least one water-soluble dye selected from the group consisting of direct dyes, acidic dyes, basic dyes and reactive dyes.

10. The ink jet recording medium of claim 8 wherein the aqueous ink contains a water-soluble dye which is a coloring material for food.

11. An ink jet recording medium for receiving an aqueous ink coloring for foods, said recording medium obtained by coating on a support a coating composition containing a poly(dialkanol allylamine) derivative of the formula:

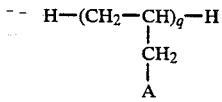

(I)

and/or a poly(dialkanol modified alkylene glycol) derivative of the formula:

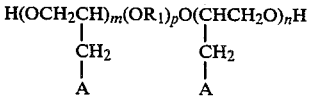

(II)

wherein R is an alkylene group having 2 to 4 carbon atoms or a hydroxyalkylene group having 3 to 4 carbon atoms; p is an integer of 1 to 3; A is a tertiary and/or quaternary dialkanolamino group represented by the formulae:

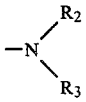

(III)

and

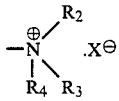

(IV)

in which $R_2$ and $R_3$ are independently a hydroxyalkyl group having 2 to 3 carbon atoms; $R_4$ is hydrogen or an alkyl group having 1 to 2 carbon atoms; and $X^{\ominus}$ is halogen or an anion of the formula: $CH_3SO_4^{\ominus}$ or $C_2H_5SO_4^{\ominus}$; m and n are independently an integer of 5 to 50 and $m+n=10$ to 100; and q is an integer of 10 to 1000.

12. An ink jet recording medium according to claim 11, wherein the coating composition comprises a poly(dialkanol allylamine) derivative of the formula (I) and/or a poly(dialkanol modified alkylene glycol) derivative of the formula (II) and one or more components selected from the group consisting of pigments and binders.

13. The ink jet recording medium of claim 11 wherein the aqueous ink contains at least one water-soluble dye selected from the group consisting of direct dyes, acidic dyes, basic dyes and reactive dyes.

14. The ink jet recording medium of claim 11 wherein the aqueous ink contains a water-soluble dye which is a coloring material for food.

15. An ink jet recording medium for receiving an aqueous ink, said recording medium including a support coated or impregnated with a poly(dialkanol allylamine) derivative of the formula:

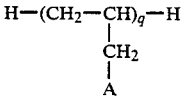

and/or a poly(dialkanol modified alkylene glycol) derivative of the formula:

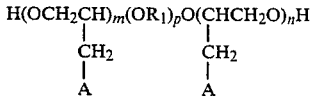

(II)

wherein R is an alkylene group having 2 to 4 carbon atoms or a hydroxyalkylene group having 3 to 4 carbon atoms; p is an integer of 1 to 3; A is a tertiary and/or quaternary dialkanolamino group represented by the formulae:

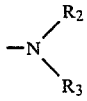

(III)

and

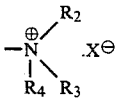

in which $R_2$ and $R_3$ are independently a hydroxyalkyl group having 2 to 3 carbon atoms; $R_4$ is hydrogen or an alkyl group having 1 to 2 carbon atoms; and $X^{\ominus}$ *is halogen or an anion of the formula:* $CH_3SO_4^{\ominus}$ or $C_2H_5SO_4^{\ominus}$; m and n are independently an integer of 5 to 50 and $m+n=10$ to 100; and q is an integer of 10 to 1000.

16. The ink jet recording medium of claim 15 wherein the aqueous ink contains at least one water-soluble dye selected from the group consisting of direct dyes, acidic dyes, basic dyes and reactive dyes.

17. The ink jet recording medium of claim 15 wherein the aqueous ink contains a water-soluble dye which is a coloring material for food.

* * * * *